US005555917A

United States Patent [19]

Quigley

[11] Patent Number: 5,555,917

[45] Date of Patent: Sep. 17, 1996

[54] SIXTEEN HARNESS MULTI-LAYER FORMING FABRIC

[75] Inventor: Scott Quigley, Simpsonville, S.C.

[73] Assignee: Wangner Systems Corporation, Greenville, S.C.

[21] Appl. No.: 514,322

[22] Filed: Aug. 11, 1995

[51] Int. Cl.[6] ..... D03D 13/00

[52] U.S. Cl. ..... 139/383 A

[58] Field of Search ..... 139/383 A

[56] References Cited

U.S. PATENT DOCUMENTS

| | | | |
|---|---|---|---|
| 4,709,732 | 12/1987 | Kinnunen | 139/383 A |
| 4,789,009 | 12/1988 | Troughton | 1339/383 A |
| 5,016,678 | 5/1991 | Borel et al. | 139/383 A |
| 5,067,526 | 11/1991 | Herring | 139/383 A |
| 5,158,117 | 10/1992 | Huhtiniemi | 139/383 A |

*Primary Examiner*—Andy Falik

*Attorney, Agent, or Firm*—Henry S. Jaudon; Cort Flint

[57] ABSTRACT

A wear resistant dual layer papermaking fabric having an upper paper fiber support surface and a lower machine contact surface. The support surface comprises a first plurality of weft yarns interwoven with warp yarns in a balanced twill weave pattern. The machine surface comprises a second plurality of weft yarns interwoven with the warp yarns in a second balanced twill weave pattern. The machine surface includes weft floats which pass beneath at least twelve consecutive of the warp yarns and are bound at opposite ends by binding points in which the weft yarn passes above at least two and below one consecutive of the warp yarns throughout the weave pattern. The weave pattern produces a weft yarn dominated paper support surface having a balanced twill weave pattern of weft floats which provide uniform drainage and minimal paper marking and a weft yarn dominated machine contact surface having a different balanced twill weave pattern of extended weft yarn floats which provides extended wear resistance.

24 Claims, 9 Drawing Sheets

SIXTEEN HARNESS MULTI-LAYER FORMING FABRIC

BACKGROUND OF THE INVENTION

This present invention relates to woven dual layer papermaking fabrics and more particularly to forming fabrics which are adapted for use in papermaking machines.

Dual layer papermaking fabrics are usually woven with a single set of machine direction yarns which are interlaced with and bind together two sets of cross-machine direction yarns. The cross-machine direction yarns normally are at least partially arranged in a vertically stacked manner.

Dual layer papermaking fabrics are manufactured in two basic ways, i.e. they are woven endless with there being only one set of weft yarns which extend in the machine direction or they are woven flat with there being only one set of warp yarns which extend in the machine direction. The papermaking fabric of the invention is preferably woven flat.

Papermaking fabrics must possess stability in both the machine and cross machine direction so that uniform drainage and uniform drying of the paper product occurs. The papermaking fabric must possess a smooth, tightly woven paper support surface with smooth evenly formed knuckles to minimalize wire markings and to provide for uniform marking throughout. Finally they must have extended wearability.

Efforts to maximize each of these requirements to date have not been totally successful. In order to increase wear, it is known to use coarse weft yarns for the lower layer. It is also known to weave the weft yarns so that extended weft floats appear also on the running or machine surface. Usually the warp yarns are woven with the weft so that there are minimal appearances of the warp yarn on the running surface.

In order to provide a substantially planar paper support surface with adequate drainage, smaller and in some instance a greater number of weft yarns are woven with the warp yarn to form the upper layer or support surface of the fabric. This weave must be stable so that uniform and minimal markings are made on the paper sheet while allowing for the necessary drainage through the fabric.

Problems, particularly on the running surface, remain with this construction. The use of large and stiff weft yarns woven in a pattern which products long or extended floats have in the past created uneven drainage and an unstable surface on both the support and machine surface. Because of its stiffness the weft yarns create floats which tend to loop or not lie flush against the warp yarns. These floats have a tendency to slip or sag in a manner as to become un-stacked or mis-aligned with the weft yarn of the opposite layer. This movement of the weft yarn floats creates uneven drainage cavities which results in uneven drainage. It also creates a surface in which the knuckles are not uniformly arranged which causes the markings on the paper sheet to be non-uniform.

Accordingly, it is an object of this invention to provide a multilayer papermaking fabric which overcomes the above set forth conditions;

Another object of the present invention is to provide a multilayer papermaking fabric having machine surface weft yarn floats which provide improved wear resistance and in which the weft yarn floats are securely bound with the warp yarns;

Another object of the present invention is to provide a papermaking fabric which maintains constant drainage during use;

Another object of the invention is to provide a papermaking fabric in which the support and machine surfaces are woven in a balanced twill weave pattern;

Another object of the invention is to provide a papermaking fabric in which the balanced twill weave pattern of the support surface and the machine surfaces differ;

Another object of the invention is to provide a multilayer papermaking fabric which is capable of producing fine paper.

SUMMARY OF THE INVENTION

The above objectives are accomplished according to the present invention with a wear resistant dual layer papermaking fabric having an upper fiber support surface and a lower machine contact surface. The papermaking fabric is woven with first and second weft yarns arranged in stacked fashion. The support surface comprises the first plurality of weft yarns interwoven with warp yarns with these first weft yarns and warp yarns being woven in a balanced twill weave. The pattern of this balanced twill weave has weft floats passing over four warp yarns and beneath one warp yarn over the paper support surface.

The machine contacting surface comprises the second plurality of weft yarns woven with the warp yarns. These second weft yarns and the warp yarns are woven in a second balanced twill weave in which weft floats pass beneath at least twelve of the warp yarns and above at least two of the warp yarns throughout the pattern repeat. The weft floats formed by the second weft yarns are bound at opposite ends by passing above, below and above concertive warp yarns so that the floats are held aligned with the first weft yarns.

The stacked pairs of first and second weft yarns are arranged along the length of the papermaking fabric with at least three adjacent of the warp yarns passing over or under the first and second weft yarns to appear on the support and machine surfaces simultaneously along the length of said papermaking fabric. There may be four adjacent of the warp yarns which pass over and under the first and second weft yarns to appear simultaneously on both surfaces of the papermaking fabric.

There may be an equal number of the first and second weft yarns per pattern repeat or the number of the first weft yarns may be twice that of the second weft yarns per pattern repeat.

The first weft yarns are formed of first and second sets of yarns having different diameters. The first set of the first weft yarns may have a larger diameter than the second set of the first weft yarns. Normally, the first set of the first weft yarns are woven in stacked relationship with the second weft yarns. The second weft yarns normally have a larger diameter than the first weft yarns. The warp yarns usually have a smaller diameter than the weft yarns.

The first and second weft yarns along with the warp yarns are formed of any one of polyamide, polyester, polyetheretherketones or a blend of polyamide and polyesters polymers. The yarns of each group are usually in the form of monofilaments of the same polymer.

The weave pattern repeat may comprise sixteen warp yarns and thirty-two first and second weft yarns, or it may comprise sixteen warp yarns and forty-eight first and second weft yarns. A multilayer papermaking fabric having an upper layer having a support surface and a lower layer having a machine surface. The support surface comprises a plurality of first weft yarns and a plurality of warp yarns woven together in a balanced twill weave pattern in which certain of the first weft yarns pass over a variable number of the warp yarns while other of the first weft yarns pass over a constant number of the warp yarns throughout the pattern repeat. The machine surface comprises a plurality of second weft yarns and a plurality of warp yarns woven together in a second balanced twill weave pattern in which the second weft yarns pass uniformly below at least twelve of the warp yarns and over at least two of the warp yarns throughout the pattern repeat.

The warp yarns are woven so that each of the warp yarns weaves over the first weft yarns and beneath the second weft yarns at least four times per pattern repeat to secure the upper and lower layers together into a stable multilayer fabric.

The second weft yarns appearing on the machine surface form alternately arranged floats passing first below at least twelve and then above one of the warp yarns.

In passing beneath the twelve warp yarns, the second weft yarns form floats having opposed ends. These ends are anchored in the lower layer by weaving the second weft yarns below two and above one of adjacent ones of the warp yarns. Alternatively, the second weft yarns are woven below three and above one of adjacent ones of the warp yarns.

The first and second weft yarns are woven in stacked pairs along the length of the fabric. At least four adjacent of the warp yarns pass around the first and second weft yarns of the stacked pairs of weft yarns to appear on the support and machine surfaces simultaneously or along a single transverse axis throughout the weave pattern. The appearances of the four adjacent of the warp yarns are arranged on the upper and lower surfaces of the fabric in diagonal rows along the length of the weave pattern.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENT

Figure 2:
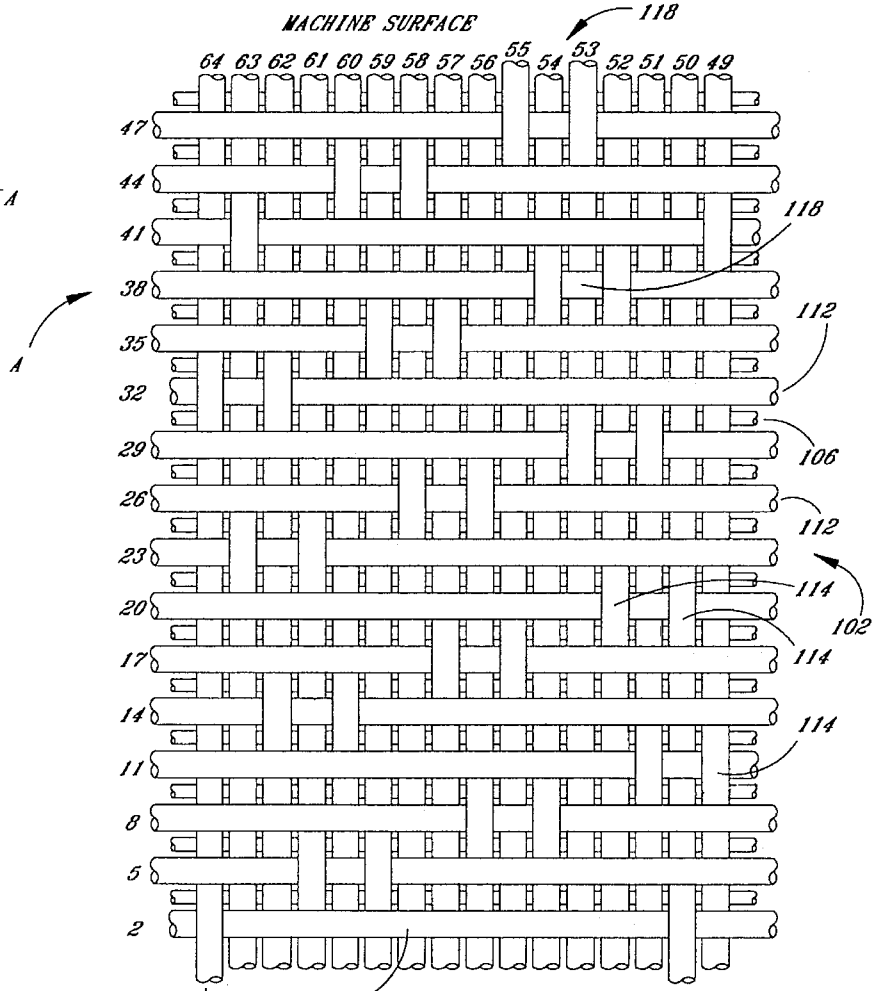
FIG. 2 is top view of the first embodiment showing the machine surface through a single repeat of the weave pattern.
Figure 1:
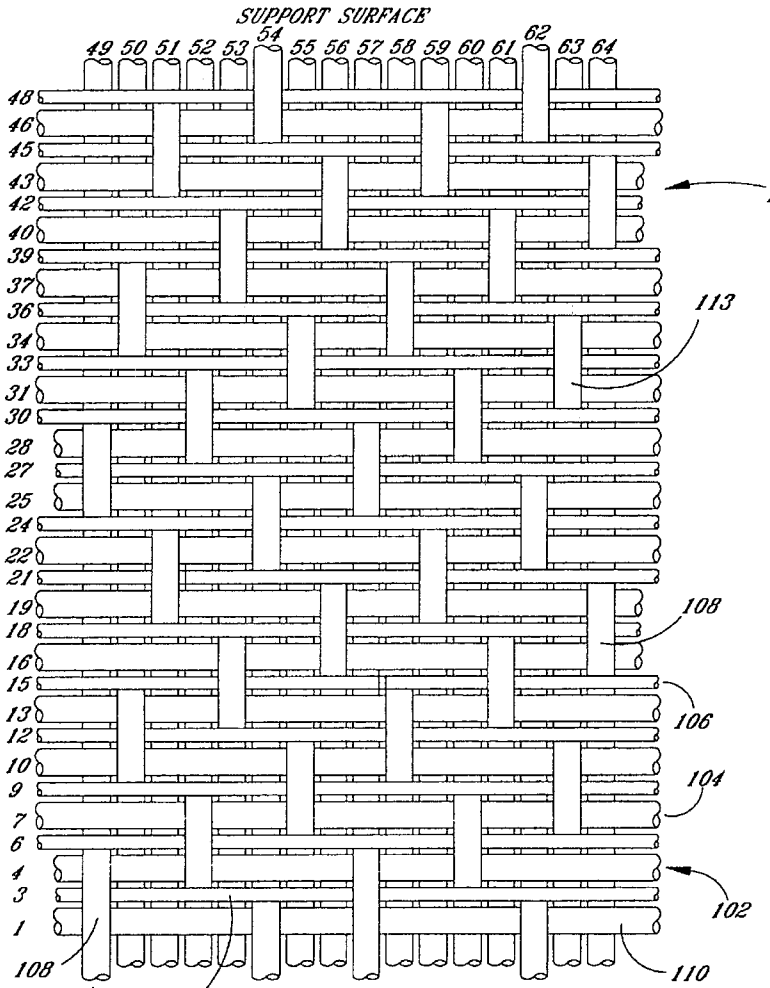
FIG. 1 is a top view of a first embodiment of the invention showing the support surface through a single repeat of the weave pattern.

Referring now in more detail to the drawings, the invention will now be described in more detail.

Turning to FIGS. 1–4, a first embodiment of the papermaking fabric of the invention is shown through a complete repeat of the weave pattern as a two-layer papermaking fabric A.

The weave pattern of this fabric comprises forty eight weft yarns 102, with the individual picks numbered 1–48, interwoven with sixteen warp yarns 100 with each warp yarn of the pattern repeat numbered 49–64. Weft yarns 102 include upper weft yarns 104, 106 which are arranged in alternating fashion along the length of the fabric and weave with warp yarns 100 to form the paper fiber support surface. Weft yarns 104 are normally larger in diameter than weft yarns 106.

Warp yarns 100 weave with weft yarns 102 to form warp direction floats 108 which are arranged in diagonal rows forming a balanced twill weave pattern. Warp yarns 100 also pass beneath thirteen weft yarns 102 between floats 108 forming weft floats 109, 110 resulting in a support surface which is weft dominated.

The machine contacting surface, shown in FIG. 2 is formed with warp yarns 100 weaving with lower weft yarns 112 of weft yarns 102. On the running or machine surface warp yarns 100 appear only as warp direction knuckles 114 as the weave is designed to expose a minimum of the warp yarns to machine wear. The lower weft yarns 112 are woven with warp yarns 100 to pass over thirteen consecutive warp yarns forming floats 116 before weaving beneath, above and beneath consecutive warp yarns 100 forming binding points 118. These binding points 118 securely engage with weft yarns 112 at the opposite ends of floats 116 to bind the weft in a stationary position and hold the floats 116 aligned with upper weft yarns 104.

Figure 3:
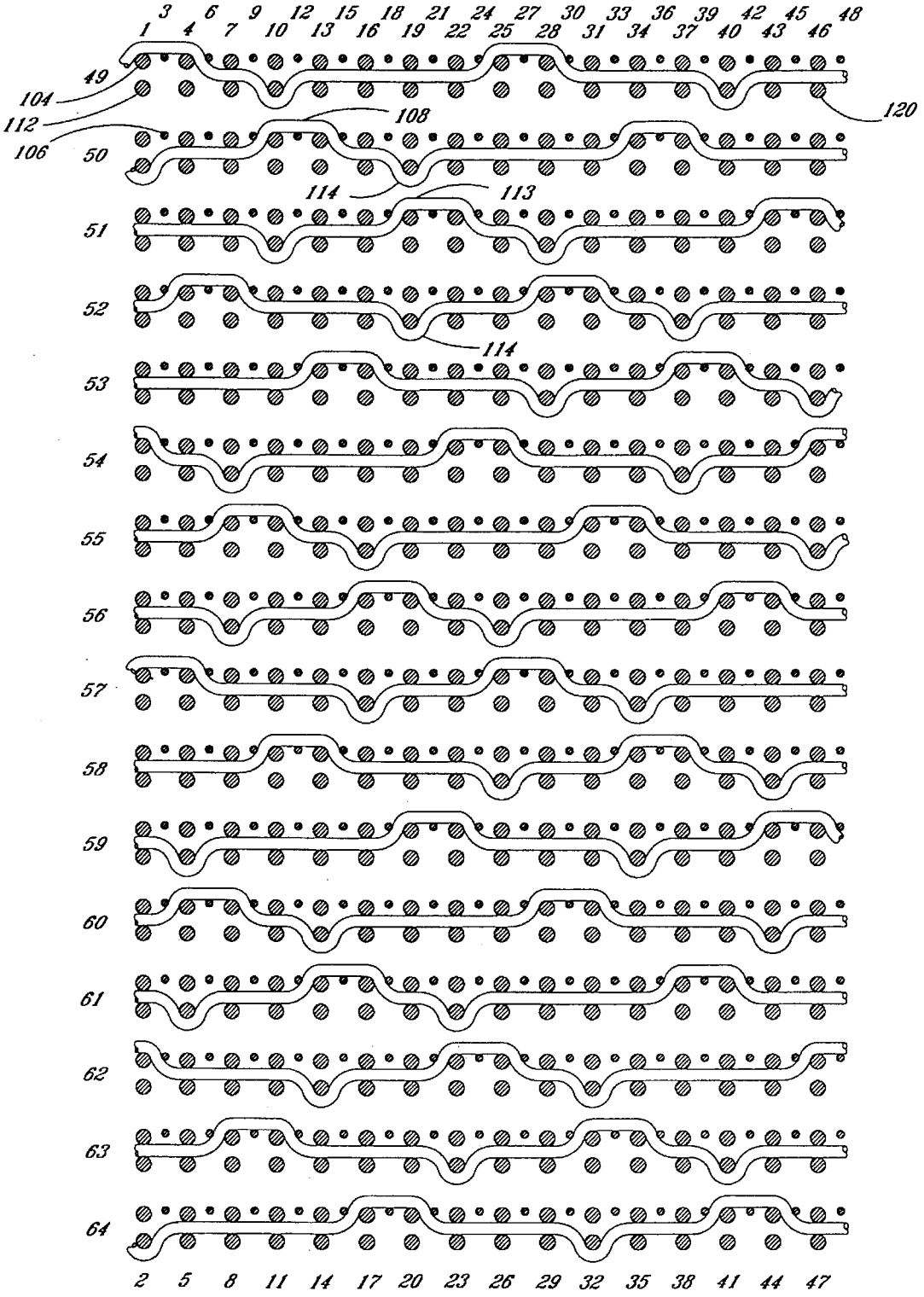
FIG. 3 is a schematic side view showing each warp yarn of the weave pattern as it interweaves with the weft yarns of the weave pattern.
Figure 4:
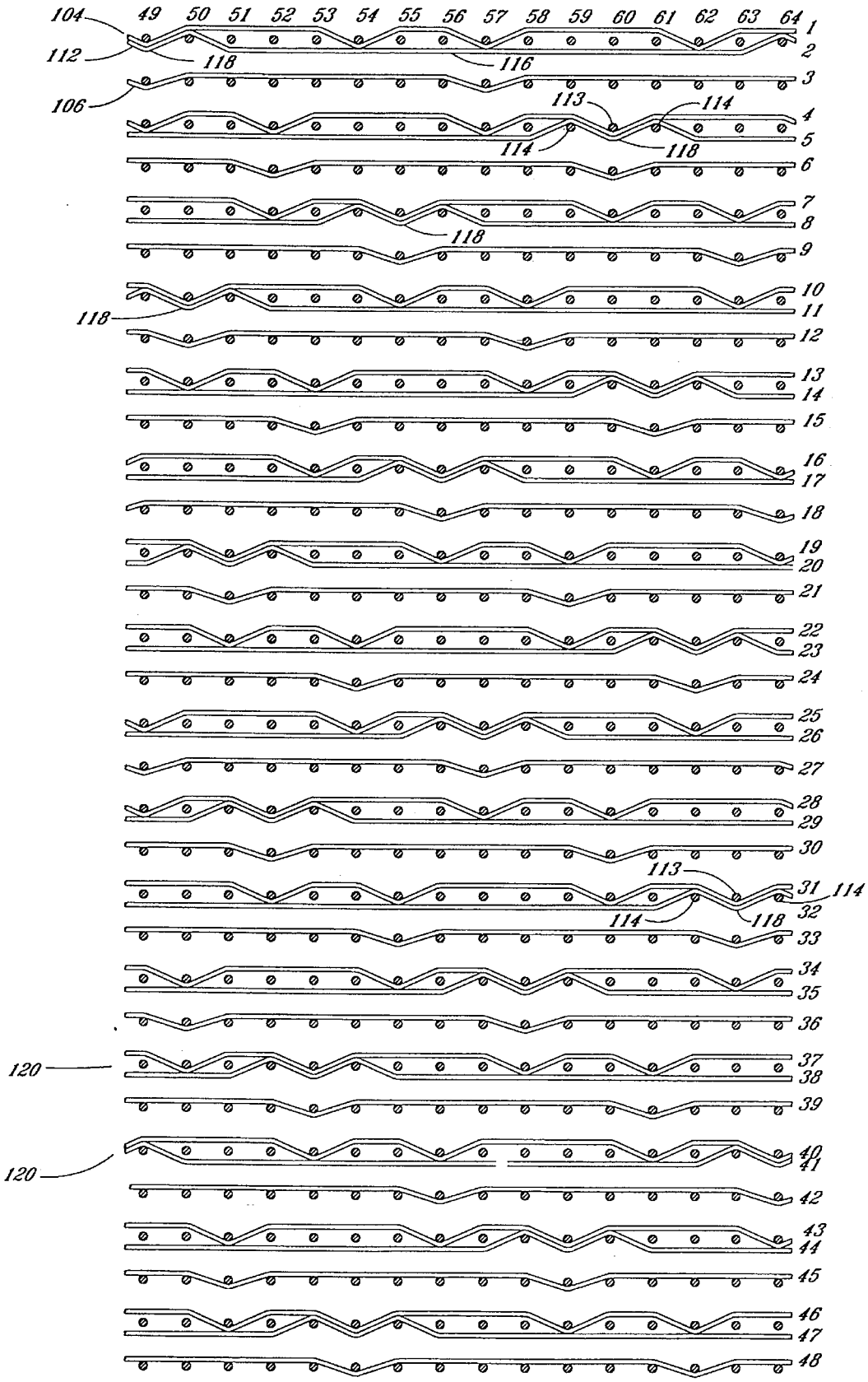
FIG. 4 is a schematic side view showing each weft yarn of the weave pattern as it traverses through the warp yarns of the weave pattern.

As better shown in FIGS. 3 and 4, weft yarns 104,112 are arranged throughout the weave pattern in vertically stacked pairs 120 while weft yarns 106 are arranged to lie only in the upper layer forming the support surface. Weft yarn 106 are arranged in alternating relationship with weft yarns 104 throughout the weave pattern. Lower weft yarns 112 forming floats 116 are locked in position at opposite ends by binding points 118 which comprise a pair of crossovers or knuckles 114 on the machine surface spaced by crossover 113 on the support surface. These crossovers are formed by consecutive warp yarns 100 and appear along a single axis transverse of the fabric.

FIG. 3 shows also the stacked arrangement of weft yarns 104, 112 which are separated by weft yarns 106. Also, warp knuckles 114 appear along diagonal lines at spaced intervals over the weave pattern repeat forming a balanced twill weave pattern. The majority of the machine surface is comprised of exposed weft yarns 112. In operation the warp maintains the stability of the fabric by absorbing most of the tension exerted during operation. It is therefore desirable that it be subjected to a minimum of exposure to the machine elements. On the other hand, the weft yarns absorb a minimum of tension and therefore may prolong the fabric life by absorbing a majority of contact with the machine.

FIG. 3 shows the warp weft relationship of each warp thread throughout the weave pattern while FIG. 4 shows the same for each weft thread throughout the weave pattern.

The two layered papermaking fabric B shown in FIGS. 5–8 comprises a second embodiment of the invention. The weave pattern of fabric B comprises sixteen warp yarns 130, with each warp yarn of the pattern repeat numbered 49–64, which are arranged in a single layer and interwoven with thirty six upper weft yarns 132, 134 and sixteen lower weft yarns 136, with each weft yarn of the pattern repeat numbered 1–48. Upper weft yarns 132, which are normally larger than upper weft yarns 134, are arranged in alternating fashion with weft yarns 134 along the length of the fabric.

Warp yarns 130 weave with weft yarns 132 and 134 to form warp direction floats 136 which are evenly dispersed over the paper fiber support surface of fabric B in diagonal rows forming a balanced twill weave pattern. Warp yarns 130 also weave under thirteen consecutive weft yarns 132, 134 between floats 136 forming weft floats 138, 140 and providing a paper fiber support surface which is weft dominated.

Figure 6:
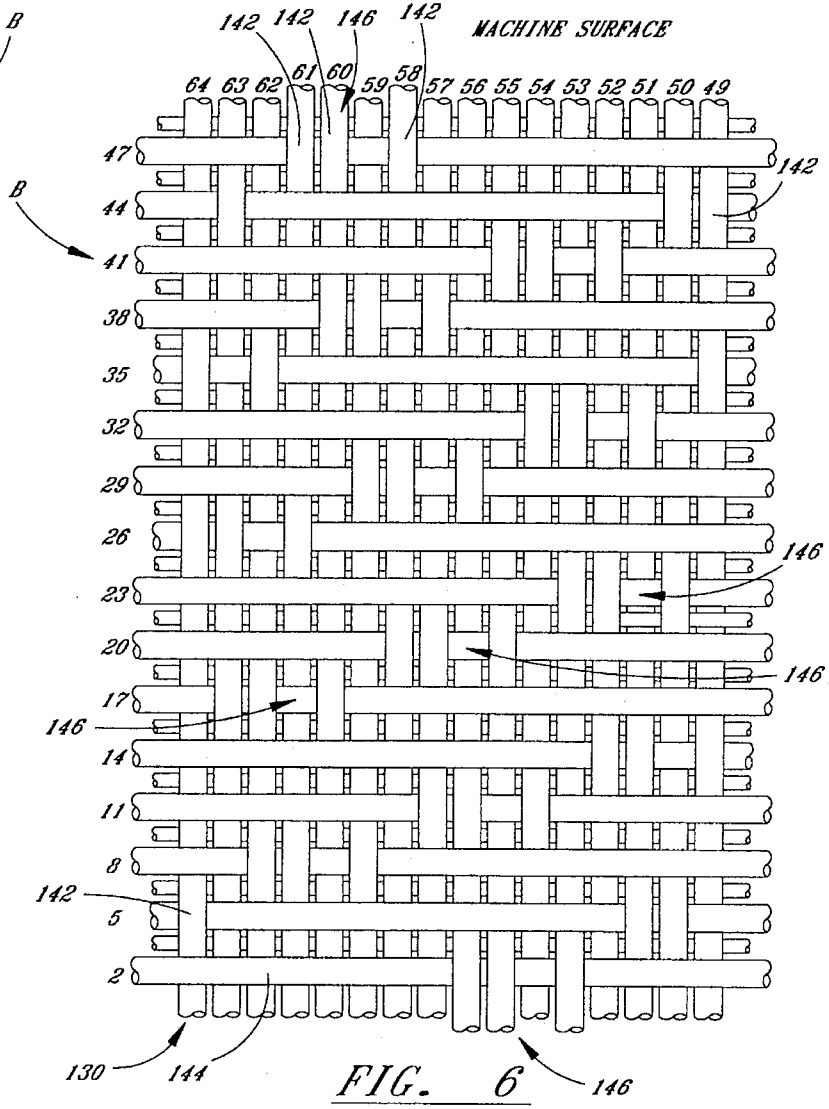
FIG. 6 is top view of the second embodiment showing the machine surface through a single repeat of the weave pattern.
Figure 5:
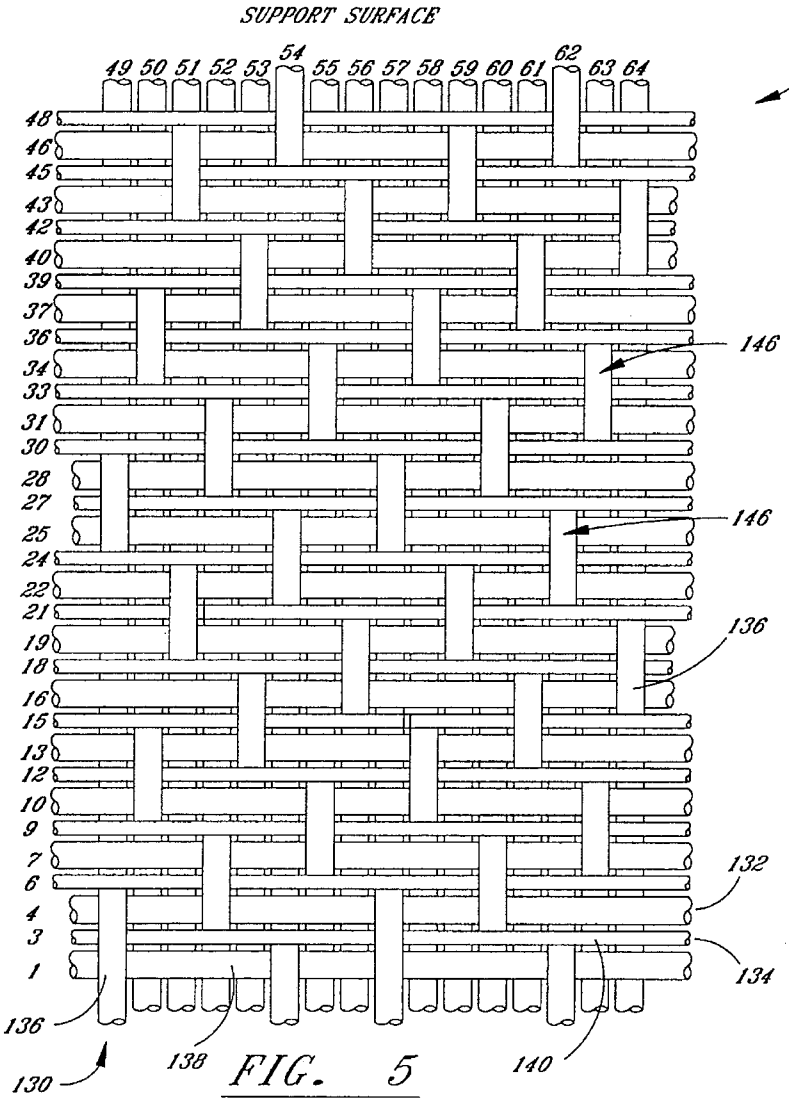
FIG. 5 is a top view of a second embodiment of the invention showing the support surface through a single repeat of the weave pattern.

The machine surface, shown in FIG. 6, is also woven in a balanced twill weave pattern as warp yarns 130 form knuckles 142 which appear in evenly arranged diagonal rows across the weave pattern.

Weft yarns 136 weave with warp yarns 130 to form cross machine direction floats 144 which pass over twelve consecutive warp yarns 130 before passing under two, over one and under one of the warp yarns forming binding points 146. This arrangement securely binds opposite ends of floats 144 in position on the machine surface of the fabric.

Weft yarns 130 are woven in vertical stacked relationship with weft yarns 136 to form stacks 147. Stacks 147 are spaced along the length of the fabric in alternating fashion by weft yarns 134.

Figure 7:
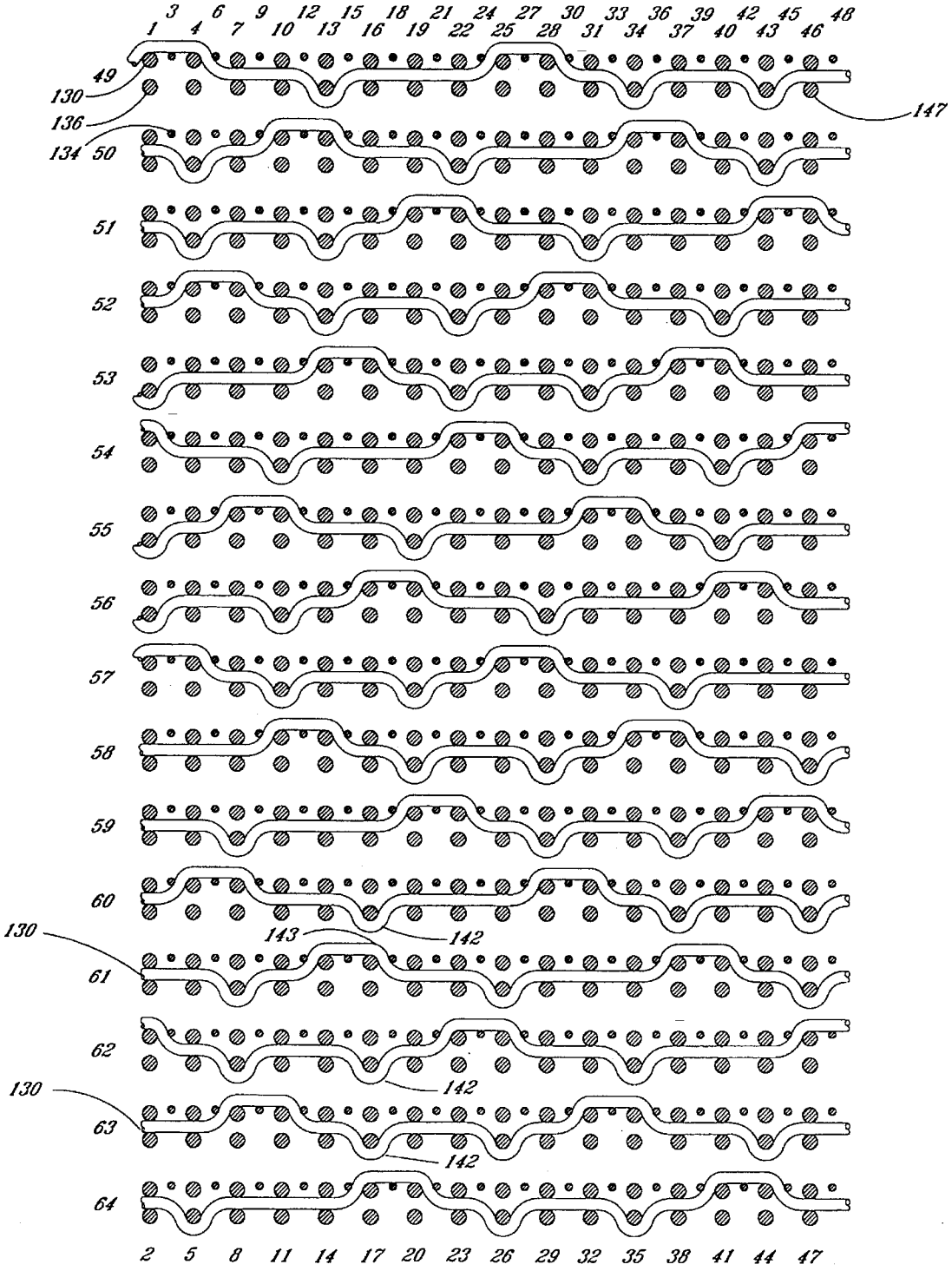
FIG. 7 is a schematic side view showing each warp yarn of the weave pattern as it interweaves with the weft yarns of the weave pattern.
Figure 8:
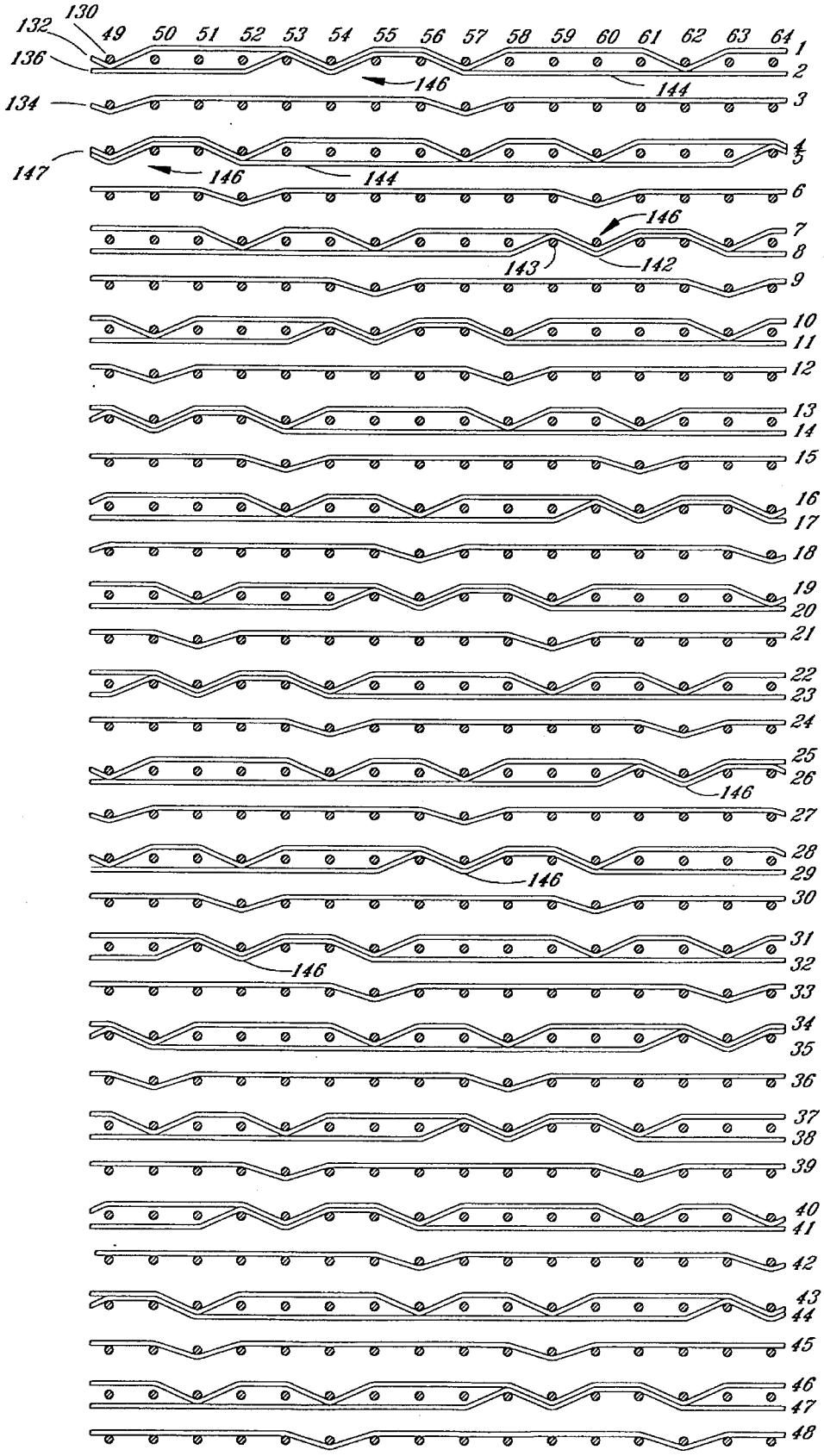
FIG. 8 is a schematic side view showing each weft yarn of the weave pattern as it traverses through the warp yarns of the weave pattern.

FIGS. 7 and 8 show binding points 146 formed by four consecutive warp yarns 130 weaving below lower weft yarn 136 or above upper weft yarn 132 to form crossovers or knuckles 142 or 143 on the support and machine surfaces. These crossovers appear simultaneously or along a single axis transverse of the fabric and form the binding points 146.

Again FIG. 7 shows the warp weft relationship of each warp yarn throughout the weave pattern and FIG. 8 shows the same for each weft yarn throughout the weave pattern.

Turning now to FIGS. 9–12, a third embodiment of the invention is shown. The papermaking fabric C shown in this embodiment is a double fabric having sixteen upper layer weft threads 152 and sixteen lower weft threads 154 arranged in vertical stack 156 and interwoven with a single layer of warp yarns 150. Each weft and warp yarn of the weave pattern is identified 1–48.

Figure 9:
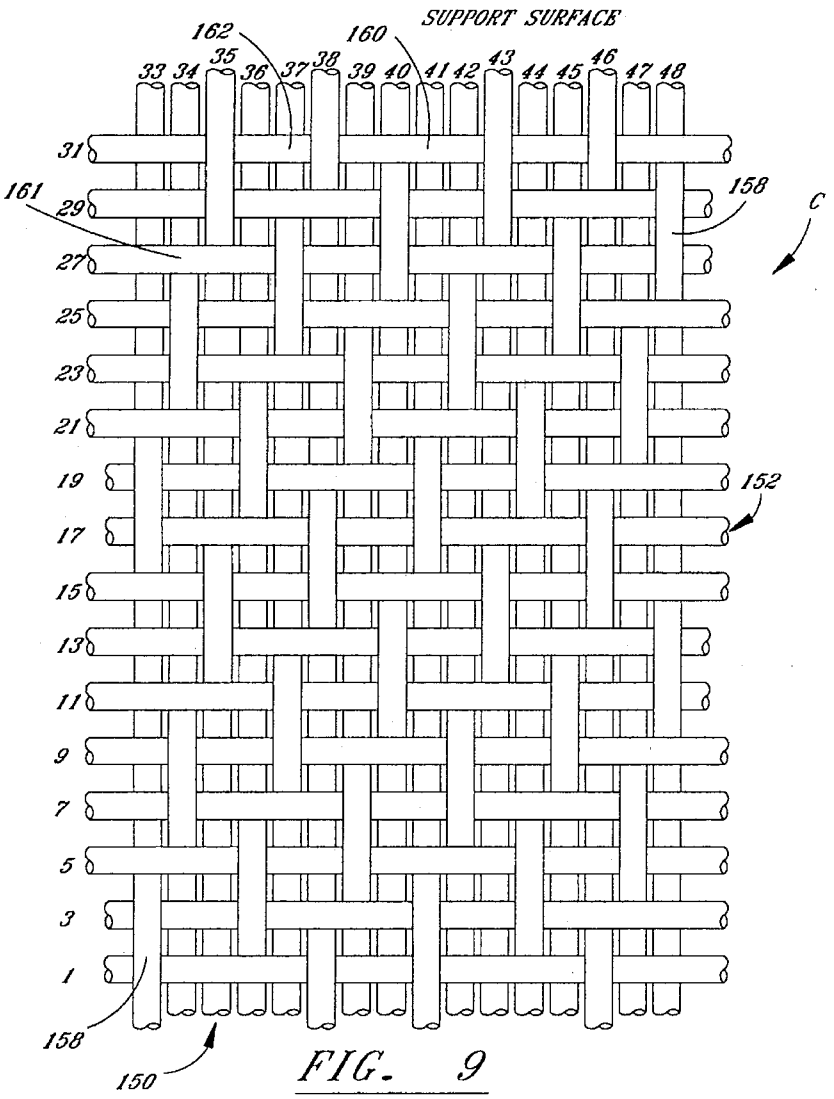
FIG. 9 is a top view of a third embodiment of the invention showing the support surface through a single repeat of the weave pattern.

FIG. 9 is a top view of papermaking fabric C showing the paper fiber support surface. Warp yarns 150 form short warp direction floats 158 which we arranged in diagonal rows along the length of the fabric and comprise a balanced twill weave pattern. Weft yarns 152 are shown as passing over first two and then four consecutive warp yarns in a repeating fashion forming weft floats 157, 162. The support surface is woven to be weft dominated.

Figure 10:
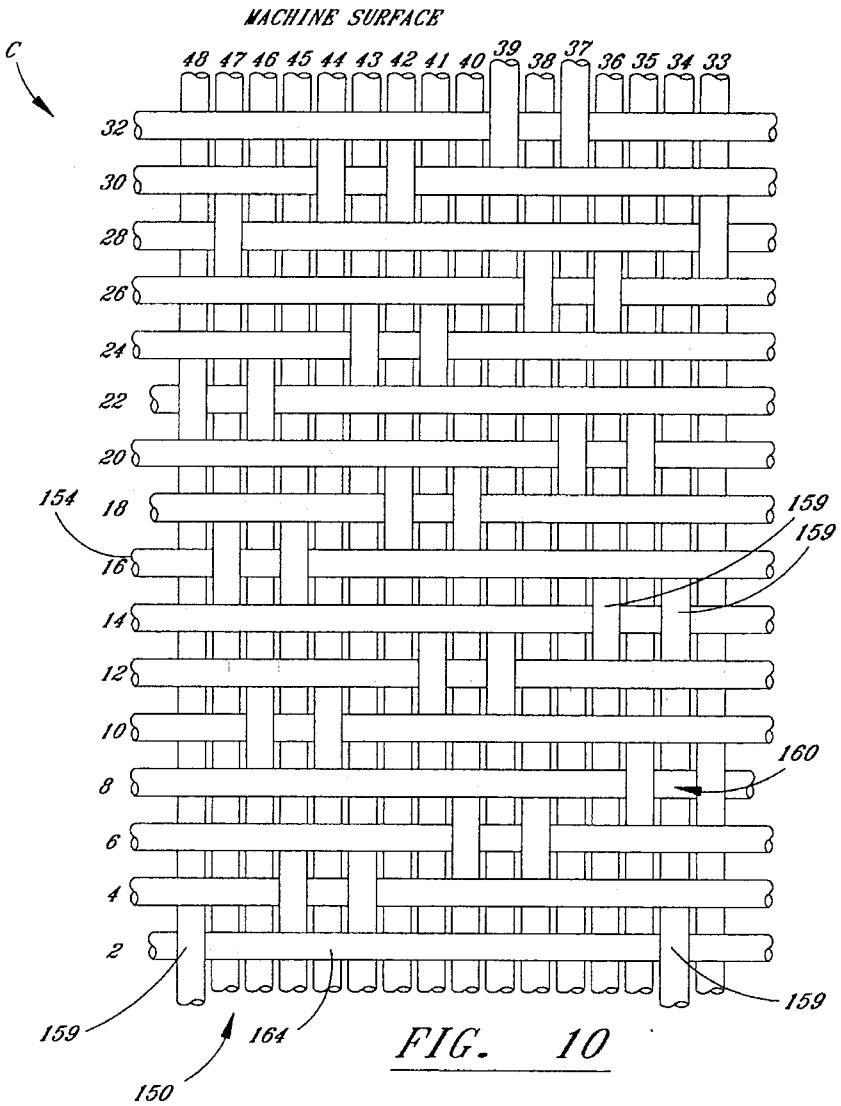
FIG. 10 is top view of the third embodiment showing the machine surface through a single repeat of the weave pattern.

FIG. 10 is a top view of the machine surface of papermaking fabric C. Again the warp yarns 150 weave with weft yarns 154 in a balanced twill weave to pass under a majority of the weft yarns in repeating fashion forming warp knuckles 159 along diagonal rows. Weft yarns 154 are woven to pass under thirteen warp yarns 150 forming floats 164 between binding points 160. Binding points 160 securely tie and hold floats 164 in position by weaving under, over and under consecutive warp yarns 150 forming knuckles 159 on the machine surface and 161 on the support surface. The weave pattern of papermaking fabric C provides that the machine surface is also woven to be weft yarn dominated with warp yarns 150 appearing only minimally.

Figure 11:
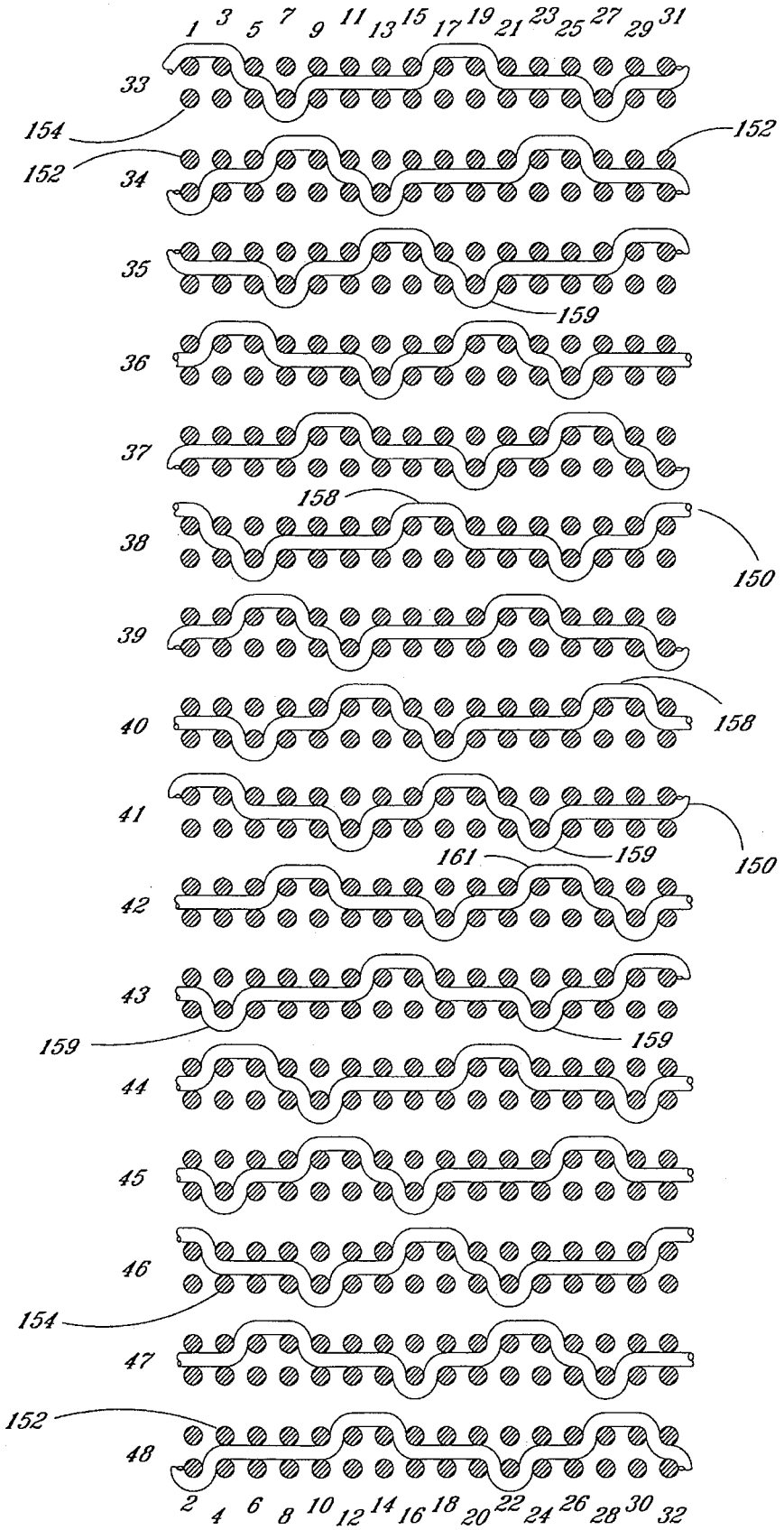
FIG. 11 is a schematic side view showing each warp yarn of the weave pattern as it interweaves with the weft yarns of the weave pattern.
Figure 12:
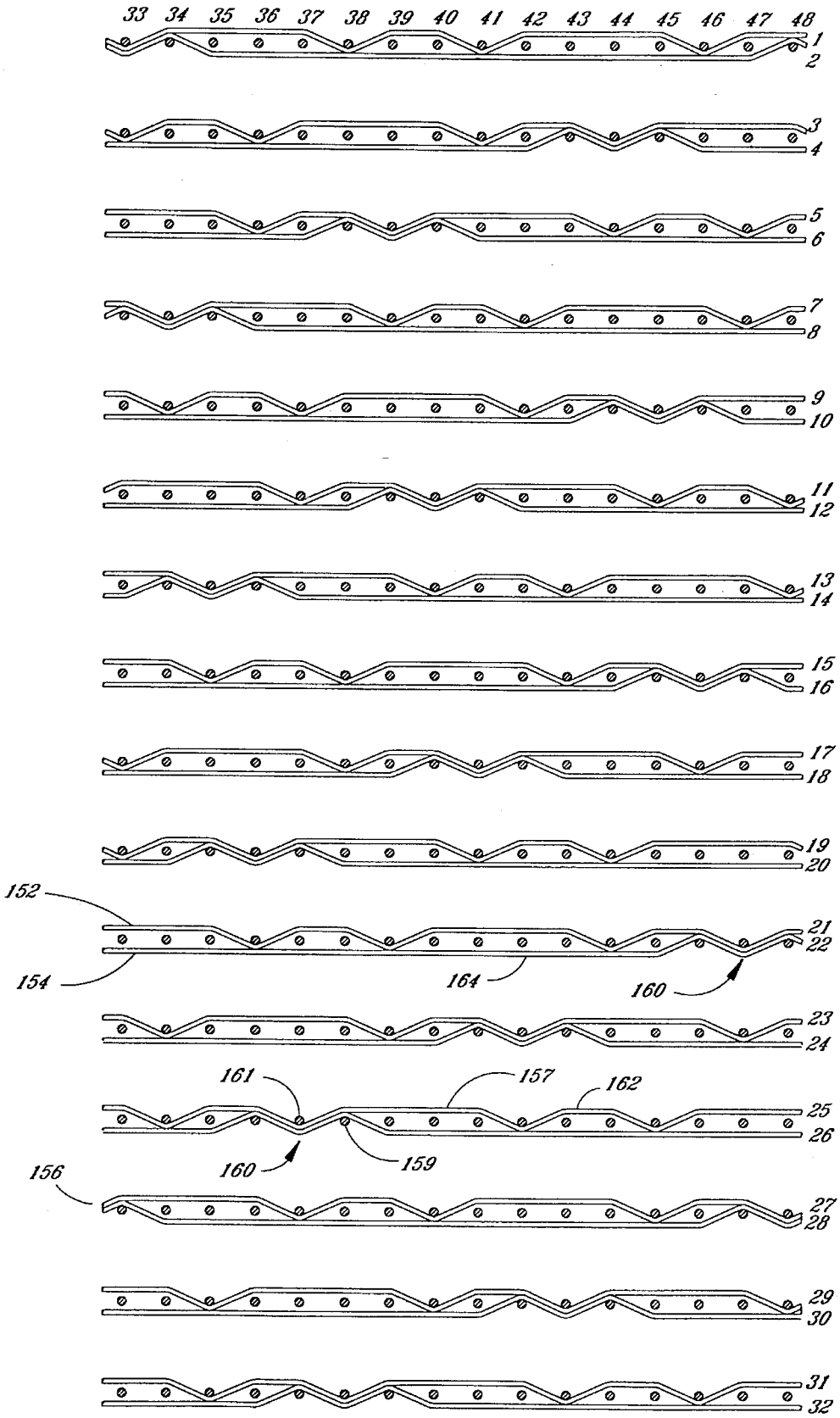
FIG. 12 is a schematic side view showing each weft yarn of the weave pattern as it traverses through the warp yarns of the weave pattern.

FIG. 11 is a side view showing the position of each warp yarn 150 relative to the stacked weft yarns 152, 154 through one repeat of the weave pattern. FIG. 12 is another side view showing the positions each of weft yarns 152, 154 relative to warp yarns 150 through one repeat of the weave pattern.

It is preferred that the warp yarns and weft yarns forming both the support surface and the machine surface be formed of the same material. It is also within the scope of this invention to provide different materials for the weft yarns forming the support and machine surfaces. The machine surface yarns may be more abrasion resistant while the support surface yarns may be more flexible. The warp yarns may also differ from the weft yarns. It may be desirable that the warp yarns be more resistant to stretching or elongating than the weft yarns.

Acceptable yarns may be made of polyester, polyamide, polyethylene, polyetherketone, or a blend of selected of the above. The yarns may be monofilament, multifilament or a combination of monofilament and multifilament yarns. The yarns may range in thickness between 0.02 mm and 0.26 mm with smaller yarns being on the upper layer and larger yarns on the lower layer i.e. machine surface.

It is preferred that the papermaking fabrics A, B, and C are woven to have a permeability of between 200 and 800 CFM.

While a preferred embodiment of the invention has been described using specific terms, such description is for illustrative purposes only, and it is to be understood that changes and variations may be made without departing from the spirit or scope of the following claims.

What is claimed is:

1. A wear resistant dual layer papermaking fabric having an upper paper fiber support surface and a lower machine contact surface;

said fiber support surface comprises a first plurality of weft yarns interwoven with warp yarns, said first weft yarns and said warp yarns being woven in a balanced twill weave pattern having weft floats passing over four warp yarns and beneath one warp yarn throughout each repeat of the weave pattern;

said machine contacting surface comprises a second plurality of weft yarns interwoven with said warp yarns, said second weft yarns and said warp yarns being woven in a second balanced twill weave having weft floats passing beneath at least twelve of said warp yarns and above at least two of said warp yarns throughout the weave pattern repeat whereby;

the weft yarn dominated fiber support surface having said uniform pattern of weft floats is formed to provide uniform drainage and fiber support and the weft yarn dominated machine contact surface having said uniform pattern of extended weft yarn floats is provided for extended wear resistance of said machine contact surface.

2. The papermaking fabric of claim 1 wherein said first and second weft yarns are woven in stacked fashion.

3. The papermaking fabric of claim 2 wherein said weft floats formed by said second weft yarns are bound at opposite ends of said floats by passing above, below and above consecutive warp yarns whereby said floats are held in vertical alignment with said first weft yarns.

4. The papermaking fabric of claim 1 wherein only certain of said first weft yarns are woven stacked with said second weft yarns, others of said first weft yarns are woven intermediate said stacks.

5. The papermaking fabric of claim 1 wherein said first and second weft yarns are woven in stacked pairs and at least three adjacent of said warp yarns pass around said first and second weft yarns of a selected pair of said stacked pairs to appear on said support and machine surface along a single transverse axis during a weave pattern repeat of said papermaking fabric.

6. The papermaking fabric of claim 5 wherein there are four adjacent of said warp yarns which pass around said first and second weft yarns.

7. The papermaking fabric of claim 5 wherein said appearances of said at least three of said warp yarns form binding points which are arranged on said upper and lower surfaces in diagonal rows along the length of the weave pattern repeat.

8. The papermaking fabric of claim 1 wherein there are an equal number of first and second weft yarns per weave pattern repeat.

9. The papermaking fabric of claim 1 wherein there are twice the number of first weft yarns as the number of second weft yarns per weave pattern repeat.

10. The papermaking fabric of claim 9 wherein said first weft yarns are formed of first and second sets of yarns having different diameters.

11. The papermaking fabric of claim 10 wherein said first set of said first weft yarns have a larger diameter than said second set of first weft yarns.

12. The papermaking fabric of claim 11 wherein said first set of said first weft yarns are woven in stacked relationship with said second weft yarns.

13. The papermaking fabric of claim 1 wherein said second weft yarns have a larger diameter than said first weft yarns.

14. The papermaking fabric of claim 1 wherein said first and second weft yarns are formed of one of polyamide, polyester, polyetheretherketones and a blend of polyamide and polyesters polymers.

15. The papermaking fabric of claim 14 wherein said first and second weft yarns and said warp yarns comprise monofilaments of the same polymer.

16. The papermaking fabric of claim 1 wherein said warp yarns have a smaller diameter that said first and second weft yarns.

17. The papermaking fabric of claim 1 wherein said weave pattern repeat comprises sixteen warp yarns and thirty-two first and second weft yarns.

18. The papermaking fabric of claim 1 wherein said weave pattern repeat comprises sixteen warp yarns and forty-eight first and second weft yarns.

19. A multilayer papermaking fabric having an upper layer having a support surface an a lower layer having a machine surface wherein;

said support surface comprises a plurality of first weft yarns and a plurality of warp yarns woven together in a balanced twill weave pattern in which certain of said first weft yarns pass over a variable number of said warp yarns while other of said first weft yarns pass over a constant number of said warp yarns throughout the pattern repeat;

said machine surface comprises a plurality of second weft yarns and a plurality of said warp yarns woven together in a second balanced twill weave pattern in which said second weft yarns pass uniformly below at least twelve of said warp yarns and over at least two of said warp yarns throughout the pattern repeat; and, each of said warp yarns weaves over said first weft yarns and beneath said second weft yarns at least four times per pattern repeat securing said upper and lower layers together to form said multilayer papermaking fabric.

20. The papermaking fabric of claim 19 wherein said second weft yarns appearing on said machine surface form alternately arranged floats passing first below at least twelve and then above one of said warp yarns.

21. The papermaking fabric of claim 19 wherein said second weft yarns in passing beneath said at least twelve warp yarns form floats having opposed ends, said opposed ends of said floats are anchored by binding points in said lower layer by the interlacing of said second weft yarns below two and above one of adjacent ones of said warp yarns.

22. The papermaking fabric of claim 21 wherein said second weft yarns are woven below three and above one of adjacent ones of said warp yarns.

23. The papermaking fabric of claim 19 wherein said first and second weft yarns are woven in stacked pairs along the length of said papermaking fabric and at least four adjacent of said warp yarns pass around said first and second weft yarns of said stacked pairs of said first and second weft yarns to appear on said support and machine surfaces along a single transverse axis once per weave pattern.

24. The papermaking fabric of claim 23 wherein said appearances of said four adjacent of said warp yarns are arranged on said upper and lower surfaces in diagonal rows along the length of the weave pattern.

* * * * *